US007407050B2

(12) United States Patent
Maruyama et al.

(10) Patent No.: US 7,407,050 B2
(45) Date of Patent: Aug. 5, 2008

(54) TABLET FILLING DEVICE AND PTP PACKAGING MACHINE

(75) Inventors: Shunji Maruyama, Komaki (JP); Hisanao Wate, Komaki (JP)

(73) Assignee: CKD Corporation, Aichi (JP)

( * ) Notice: Subject to any disclaimer, the term of this patent is extended or adjusted under 35 U.S.C. 154(b) by 371 days.

(21) Appl. No.: 11/243,555

(22) Filed: Oct. 5, 2005

(65) Prior Publication Data

US 2006/0032861 A1 Feb. 16, 2006

(30) Foreign Application Priority Data

May 13, 2003 (JP) ..... 2003-134385

(51) Int. Cl.
*B65G 47/24* (2006.01)

(52) U.S. Cl. ..... 198/384; 198/393; 198/397.04

(58) Field of Classification Search ..... 198/384, 198/385, 393, 397.02–397.05; 221/167
See application file for complete search history.

(56) References Cited

U.S. PATENT DOCUMENTS 3,871,295 A * 3/1975 Ackley ..... 101/40
4,104,966 A * 8/1978 Ackley et al. ..... 101/40
4,353,456 A * 10/1982 Yamamoto ..... 198/397.04
4,632,028 A * 12/1986 Ackley ..... 101/40
4,657,130 A * 4/1987 Ackley et al. ..... 198/397.04

FOREIGN PATENT DOCUMENTS

JP 2000-264301 9/2000
JP 2001-219908 8/2001

* cited by examiner

*Primary Examiner*—Mark A Deuble
(74) *Attorney, Agent, or Firm*—Muramatsu & Associates

(57) ABSTRACT

It is to provide a tablet filling device having improved quality and productivity by correctly filling the tablets in pocket parts of a container film even when the tablets have a non-circular shape such as triangle. The tablet filling device 52 has a rotary drum 2 provided with holding recesses 3 for storing the tablets 1 and transferring the tablets 1 to the downstream for filling the tablet 1 in a pocket part 44 of a container film 41. The holding recess 3 has a tablet receptacle section 3*a* that is larger than the tablet 1 supplied from a tablet feeding chute 5, and a posture correction section 3*b* that corrects the posture of the tablet 1 received in the tablet receptacle section 3*a* during the conveyance.

11 Claims, 4 Drawing Sheets

TABLET FILLING DEVICE AND PTP PACKAGING MACHINE

FIELD OF THE INVENTION

This invention relates to a technical field of a tablet filling device that fills tablets supplied from a tablet feeding chute to pocket parts formed on a container film and a PTP packaging machine equipped with such a tablet filling device.

BACKGROUND OF THE INVENTION

In general, a PTP sheet (so-called blister sheet) consists of a container film that is formed with pocket parts into which tablets etc. are loaded, and a sealing film which is air tightly attached to the container film so as to seal the opening sides of the pocket parts. Prior to the stage of attaching the sealing film to the container film, the pocket part of the container film is filled with a tablet, etc.

As a filling device which automatically fills the container film with tablets, etc., a device that is equipped with a rotary drum and a tablet feeding chute arranged adjacently to an upper part of the rotary drum is known (for example, Japanese Laid-open Patent Publication No. 2001-219908). Many recesses for conveying tablets are formed on an outer surface of the rotary drum. These recesses are configured to match with a size and a circular shape of the tablets in plan view, and are arranged by an interval which matches with an interval between the pocket parts formed on the container film.

In this arrangement, when the tablets are sequentially discharged from the tablet feeding chute to the rotary drum, the tablets are held in the recesses. When the rotary drum is rotated further and the tablets are guided to the lower part of the rotary drum, the tablets will fall into the pocket parts to fill the pocket parts.

In recent years, the configuration of a tablet are not necessarily limited to a circular shape in plan view, but tablets of various shapes, such as a triangular, rectangular, or rhombus shape, may also be manufactured. However, according to the technology disclosed by the above noted patent publication, only the recesses corresponding to the tablet of circular shape in plan view is provided. Therefore, the recess for the circular tablet could not properly accommodate other shapes of tablet, such as a triangular, rectangular, rhombus shape, and thus, there arises a situation where posture of a tablet is changed or a positional displacement of the tablet is caused in the recess. In that case, there is a problem that the tablets guided by the recesses of the rotary drum cannot correctly fall on the pocket parts of the container film.

In view of the above, an object of the present invention is to provide a tablet filling device and a PTP packaging machine having improved quality and productivity by correctly filling the tablets into the pocket parts of the container film even when the form of the tablets are not circular shape in plan view.

SUMMARY OF THE INVENTION

The tablet filling device in the present invention having a tablet feeding chute to supply tablets, and a tablet conveyance body having holding recesses capable of holding the tablets to fill the tablets into pocket parts on a container film by transferring the tablets to downstream, characterized in that the holding recess has a tablet receptacle that is larger than the tablet supplied from the tablet feeding chute, and a posture correction section that corrects the posture of the tablet received in the tablet receptacle during the conveyance.

According to the present invention, the tablet supplied from the tablet feeding chute is held in the holding recess on the tablet conveyance body. The tablet to be held is first received by the tablet receptacle section that is larger than the tablet, and then the posture of the tablet is corrected by the posture correction section during the conveyance. In this situation, since the tablet receptacle section is larger than the tablet, even if the tablet supplied from a tablet feed chute has a shape which is not a circular shape, such as a triangle, square, and rhombus shape, the tablet receptacle section can easily hold the tablet. Because the posture of the tablet is corrected by the posture correction section, even if the tablet is of a variant configuration such as a non-circular configuration, the correct posture of the tablet is obtained at the time it is filled in the pocket part of the container film, and thus, defect in the filling of the tablets will decrease. Therefore, it is possible to improve quality and productivity with regard to the production of the PTP sheet. Moreover, since the posture of the tablet is corrected by the posture correction section even if the orientations of the tablets put into the tablet feeding chute are not uniform, a mechanism for lining up the orientation of the tablets to be supplied to the tablet feeding chute becomes unnecessary. Therefore, the manufacturing cost can be reduced.

Here, the word "tablet" includes all types of tablet such as a capsule tablet or a pill in addition to all those generally referred to as a tablet. Moreover, as to the shape of the tablet, it includes tablets of various configurations in plan view, such as a approximately triangular, approximately circular shape, approximate elliptic shape, approximately rectangular shape, and approximately rhombus shape (same principle applies throughout the disclosure of the invention). Moreover, "the posture correction section which corrects the posture of the tablet that is received in the tablet receptacle section during conveyance" is interchangeable with "a posture regulation section that regulates the posture of the tablet that is received in the tablet receptacle section during the conveyance". That is, "correction of the posture of a tablet" may be changed to "regulation of the posture of a tablet", and the "posture correction section" may be changed to a "posture regulation section." Moreover, "the posture correction section which corrects the posture of the tablet received in the tablet receptacle section during the conveyance" is interchangeable with "a posture line-up section that lines up the orientation of the tablet which received in the tablet receptacle section during the conveyance". That is, "correction of the posture of the tablet" may be changed to "line-up of the orientation of the tablet" and "posture correction section" may be changed to "posture line-up section."

The tablet filling device in the present invention having a tablet feeding chute that supplies tablets, and a tablet conveyance body having holding recesses that can hold the tablet in order to fill the supplied tablets into the pocket parts of the container film by transporting the tablets to downstream, characterized in that the holding recess has a tablet receptacle section that is larger than the tablet for enabling to receive the tablet in a different posture than the posture for filling the pocket part, and a posture correction section that corrects the posture of the tablet received by the tablet receptacle section during the conveyance, and the posture maintaining means to maintain the tablet in the posture that is corrected by the posture correction section.

According to the present invention, the tablet supplied from the tablet feeding chute is held in the holding recess on the tablet conveyance body. The tablet to be held is first received by the tablet receptacle section that is larger than the tablet. However, the posture of the tablet can be different from the posture when it is filled in the pocket part. Next, the posture of the tablet received by the tablet receptacle section is corrected by the posture correction section during the conveyance, and the corrected posture of the tablet is maintained by the tablet maintaining means. In this situation, because the tablet receptacle section is larger than the tablet, even if the tablet supplied from the tablet feeding chute is of non-circular configurations, such as a triangle, a square, and a rhombus, and even if the tablet is in a different posture than the posture to be filled into the pocket part, the tablet can be easily filled into the tablet receptacle section. Since the posture of the tablet is corrected by the posture correction section, even if the tablet is the variant configuration such as a non-circular configuration, the posture of the tablet at the time it fills the pocket part of the container film will be in a correct condition, and thus, defect in filling the tablet will decrease. Therefore, it is possible to improve the quality and productivity in production of the PTP sheet. Moreover, since the posture of the tablet is corrected by the posture correction section even if the orientations of the tablet put into the tablet feeding chute are not uniform, a mechanism to correct the orientation of the tablets supplied to the tablet feeding chute becomes unnecessary. Therefore, the manufacturing cost can be reduced. In this case, the present invention may be described as "the tablet maintaining means is equipped with a suction means to suck the tablet with corrected posture." Thus, when the tablet with corrected posture is sucked by the suction means, positional displacement or posture change can be prevented, thereby more securely filling the pocket part of the container film with the tablet.

The tablet filling device in the present invention having a tablet feeding chute that supplies tablets, and a tablet conveyance body having holding recesses that can hold the tablets with at least one corner part in order to fill the supplied tablets into the pocket portion of the container film by transporting the tablets to downstream, characterized in that the holding recess has a tablet receptacle section that is larger than the tablet supplied from the tablet feeding chute, and the posture correction section that corrects the posture of the tablet so that the corner part of the tablet is oriented toward the downstream of the conveyance direction during the conveyance.

According to the present invention, the tablet supplied from the tablet feeding chute is held in the holding recess on the tablet conveyance body. The tablet to be held is first received by the tablet receptacle section that is larger than the tablet, and the posture of the tablet is corrected by the posture correction section during the conveyance. In this situation, since the tablet receptacle section is larger than the tablet, even if the tablet supplied from the tablet feeding chute has a shape with at least one corner, such as a triangle, a square, and a rhombus, the tablet can be easily held in the tablet receptacle section. Further, since the posture of the tablet is corrected by the posture correction section so that the corner part of the tablet turns toward the downstream of the conveyance direction, even if the tablet of a variant configuration having a corner part, the posture of the tablet at the time it is filled into the pocket part of the container film becomes the correct one, and thus, the defect in filling the tablet will decrease. Therefore, it is possible to improve the quality and productivity with regard to the production of the PTP sheet. Moreover, since the posture of the tablet is corrected by the posture correction section even if the orientations of the tablet supplied to the tablet feeding chute are not uniform, a mechanism to line up the orientation of tablets to be supplied to the tablet feeding chute becomes unnecessary. Therefore, the manufacturing cost can be reduced. Here, the phrase "corner part of the tablet" may mean a corner with a rounded point made by eliminating the sharp point, in addition to a sharply pointed corner.

Preferably, the posture correction section described above is arranged at the downstream of the tablet conveyance direction relative to the tablet receptacle section.

According to the above configuration, since the posture correction section is arranged at the downstream of the tablet conveyance direction relative to the tablet receptacle section, when the tablet is conveyed in the tablet conveyance direction, the tablet to be received in the tablet receptacle section is moved to the posture correction section. Thus, the posture of the tablet can be easily corrected without involving complication of equipment, since the posture of the tablet is corrected automatically in the posture correction section when the tablet is conveyed in the tablet conveyance direction.

The tablet filling device in the present invention has a tablet feeding chute that supplies tablets, and a rotary drum having holding recesses that can hold the tablets in order to fill the supplied tablets into the pocket parts of the container film by conveying the tablets to downstream. The holding recess has a tablet receptacle section that is larger than the tablet for enabling to receive the tablet in a posture different from the posture for filling the pocket part, and a posture correction section that corrects the posture of the tablet received by the tablet receptacle during the conveyance, whereby transferring the tablet received by the tablet receptacle section to the posture correction section by its own weight when the rotary drum rotates.

According to the present invention, the tablet supplied from the tablet feeding chute is held in the holding recess on the rotary drum. The tablet to be held is first received by the tablet receptacle section that is larger than the tablet. The received tablet is transported to the posture correction section due to its own weight when the rotary drum rotates, and its posture is corrected by the posture correction section. In this situation, because the tablet receptacle is larger than the tablet, even if the tablet supplied from the tablet feeding chute has a non-circular configuration, such as a triangle, a square, and a rhombus, the tablet can be easily loaded on the tablet receptacle. Since the posture of the tablet is appropriately corrected by the posture correction section, even if the tablet is of a variant configuration such as a non-circular configuration, the posture of the tablet at the time when filled in the pocket part of the container film will be in the correct condition, and thus, the defect in filling the tablet will decrease. Therefore, it is possible to improve the quality and productivity in production of the PTP sheet. Moreover, since the posture of the tablet is corrected by the posture correction section even if the orientations of the tablet supplied to the tablet feeding chute are not uniform, a mechanism to line up the orientation of tablets to be supplied to the tablet feeding chute becomes unnecessary. Therefore, manufacturing cost can be reduced.

Preferably, the holding recesses are arranged along a direction of the outer surface of the rotary drum, and the posture correction section described above is arranged at the downstream of rotation direction of the rotary drum.

According to the present configuration, since the posture correction section is arranged at the downstream of the rotation direction of the rotary drum, the tablet to be received in the tablet receptacle section is moved to the posture correction section in response to the rotation of the rotary drum. Therefore, the posture can be easily corrected without involving complication of equipment, since the posture of the tablet is automatically corrected as the rotary drum rotates.

The tablet receptacle section described above preferably has a sufficient width that allows rotation of the tablet for a predetermined angle when the received tablet is moved to the posture correction section.

According to the configuration above, since the received tablet can rotate in the tablet receptacle section when moving to the posture correction section, the posture of the tablet is securely corrected.

The posture correction section is preferably tapered toward the tablet conveyance direction.

According to the above configuration, the posture of the tablet is corrected by the posture correction section that is tapered toward the tablet conveyance direction when the tablet received in the tablet receptacle section is moved to the posture correction section. Thus, posture correction is conducted easily and securely.

Tapered side walls at the posture correction section noted above are preferably symmetrical with respect an imaginary line that penetrates about the center of the posture correction section extending to the tablet conveyance direction.

According to the above configuration, the posture of the tablet is corrected by the sidewalls that are tapered at the posture correction section that are axially symmetrical with respect to the imaginary line that penetrates about the center of the posture correction section. Thus, for example, a tablet having a pointed corner can be guided to orient to the downstream, thereby securely correcting the posture of the tablet.

The posture correction section described above is preferably configured to make contact with the tablet at the front side of the tablet conveyance direction.

According to the above configuration, the positioning of the tablet is easily and securely conducted because the tablet received in the tablet receptacle section contacts at the front of the tablet conveyance direction when the tablet is moved to the posture correction section.

Moreover, the posture correction section described above is preferably configured to have a curved surface for the part that makes a contact with the tablet.

According to the configuration above, breakage of the tablet can be prevented by reducing the impact to the tablet when making the contact because the part that makes the contact with the tablet in the posture correction section has the curved surface.

Moreover, the posture correction section is preferably configured to make a point contact with the tablet whose posture is to be corrected.

According to the above configuration, since the tablet whose posture is to be corrected makes a point contact with the posture correction section, the contact location of the tablet becomes secure, and positional and posture deviation of the tablet can be prevented. Thus, as the posture of the tablet at the time it fills the pocket part of the container film becomes further correct, the defect in filling the tablet is further reduced. Accordingly, it is possible to improve the quality and productivity with regard to the production of the PTP sheet.

Moreover, the posture correction section described above is preferably configured to make a contact at a central support point and the left and right support points with the tablet whose posture is to be corrected.

According to the configuration above, since the tablet whose posture is to be corrected makes contact at the central support point and the left and right support points of the posture correction section, the contact points of the tablet becomes more secure, and the deviation in position and posture of the tablet can be further reduced. Thus, the posture of the tablet when it is filled in the pocket part further becomes correct, and the defect in filling the tablet is further reduced. Accordingly, it is possible to improve the productivity of the PTP sheet.

Further, the bottom of the tablet receptacle section and the bottom of the posture correction section are preferably flush with each other.

According to the configuration above, because the bottom of the tablet receptacle section and the bottom of the posture correction section are flush with one another, the tablet received in the tablet receptacle section can move smoothly to the posture correction section.

Moreover, when the tablet is filled in the pocket part of the container film, it is preferable that the location of the posture correction section of the holding recess and the pocket part of the container film are positionally aligned.

According to the above configuration, the location of the posture correction section that corrects the posture of the tablet and the pocket part of the container film that is being transferred are positionally aligned with each other, the tablet whose posture is corrected by the posture correction section can be securely filled in the pocket part of the container film. Thus, defect in filling the tablet is further decreased, and the productivity of PTP sheet, etc. can be improved.

Moreover, the present invention can be applied to a PTP packaging machine that is equipped with the tablet filling device described above. In this case, it is possible to improve the productivity of PTP sheet, etc.

DETAILED DESCRIPTION OF THE INVENTION

Hereafter, an embodiment of the present invention is explained with reference to FIGS. 1 to 6.

Figure 2:
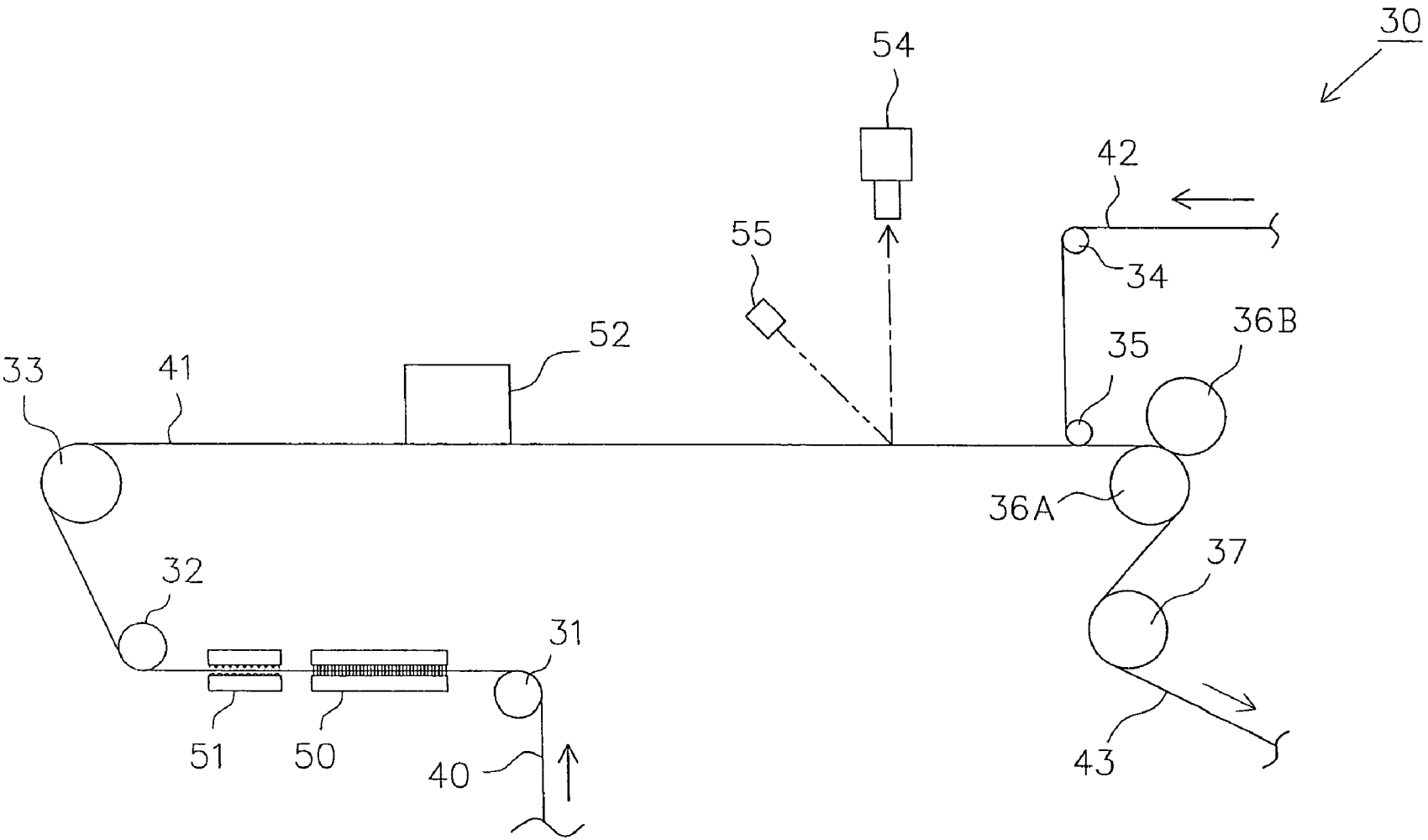
FIG. 2 is the block diagram schematically showing a basic configuration of a PTP packaging machine.

In the embodiment, as shown in FIG. 2, tablets are filled in pocket parts provided on a container film in a PTP packaging machine 30 by incorporating a tablet filling device 52 for the PTP packaging machine 30. In this embodiment, the explanation is made for the case in which the tablet has a triangular shape in plan view.

The PTP packaging machine 30 automatically packs tablets 1 (see FIG. 1, etc.) in a container film. More specifically, a film 40, made of, for example, polypropylene or PVC, is forwarded by a film advance roll 33 and tension rolls 31 and 32 to a heating apparatus 50 and a molding apparatus 51, as shown in FIG. 2. Then, in the heating apparatus 50 and the molding apparatus 51, pocket parts 44 (see FIG. 1) are formed on the film 40. Thus, when a container film 41 where the pocket parts 44 are formed thereon is forwarded under the tablet filling device 52 that is a device for filling tablets 1, the tablet filling device 52 will automatically fill each pocket part 44 with the tablet 1.

After filling the tablet 1, inspection is conducted in order to detect whether the tablet 1 exists in each pocket part 44, whether there is a defect of the tablet 1 in the pocket part, and whether there is mixture of foreign matters, etc. The inspection is conducted by test equipment consisting of a CCD camera 54, a lighting system 55, etc.

Furthermore, a sealing film 42 made of aluminum is forwarded through tension rolls 34 and 35 to the container film 41 whose pocket parts 44 are filled with the tablets 1. The container film 41 and the sealing film 42 are bonded by a pair of sealing rolls 36A and 36B. As a result, a PTP film 43 is manufactured where each pocket part 44 is filled with the tablet 1. This PTP film 43 is cut in the shape of a sheet by a cutting machine (not shown), and is forwarded to a defective sheet separation mechanism and a PTP sheet accumulation mechanism, etc.

Figure 1:
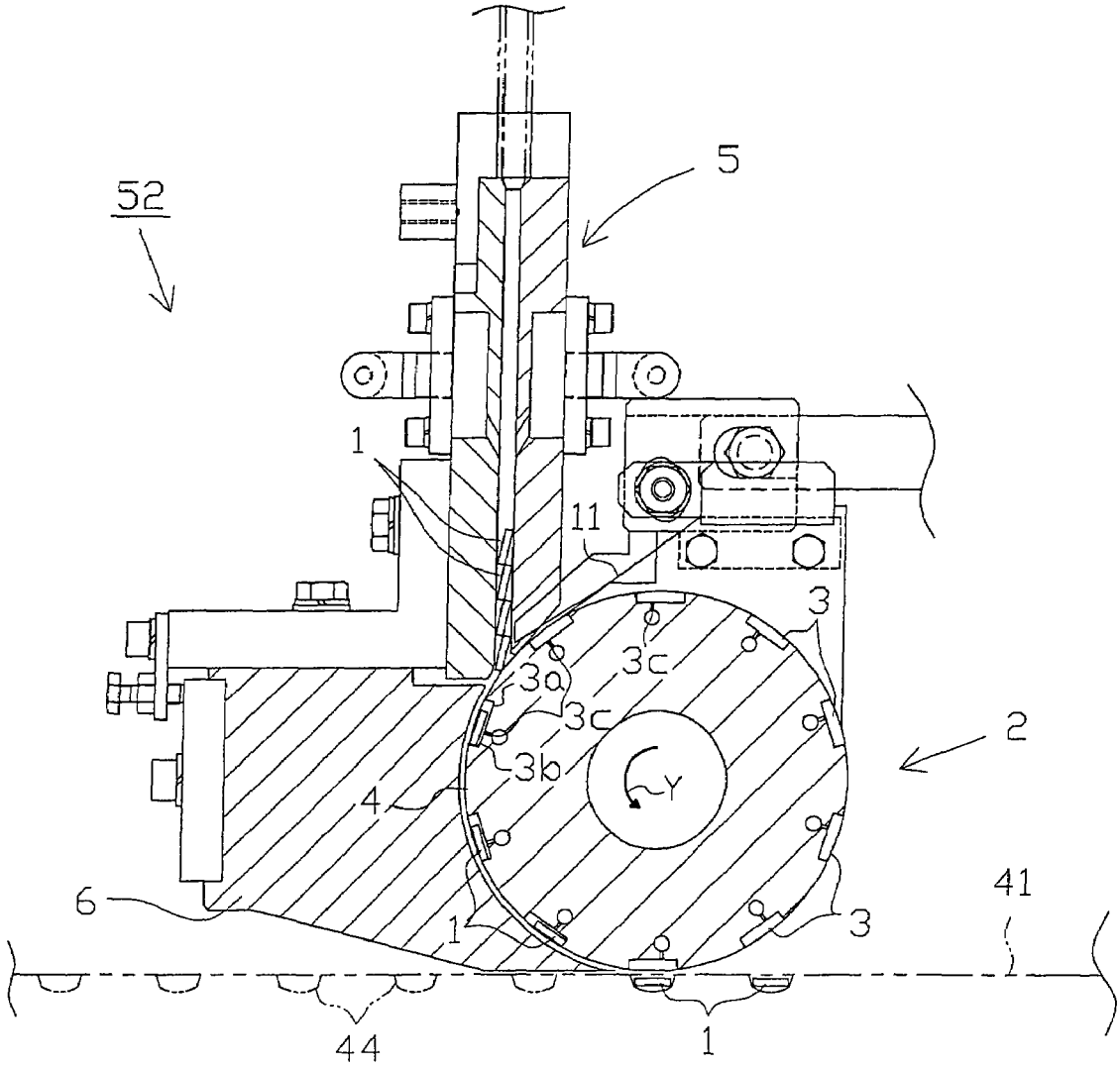
FIG. 1 is a partial cross-sectional view showing a tablet filling device in accordance with an embodiment of the present invention.

FIG. 1 shows the tablet filling device 52 that is applied to the PTP packaging machine 30 in the embodiment of the present invention. The tablet filling device 52 is equipped with a base (not shown) where a rotary drum 2 that works as a tablet conveyor is provided on the base. The rotary drum 2 is supported in such a way that can be rotatable by a motor which is not shown.

Figure 3:
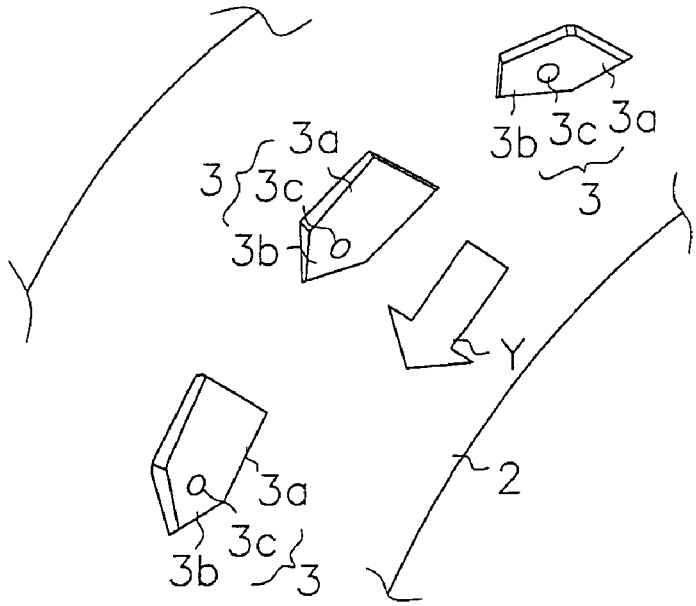
FIG. 3 is a partial perspective view schematically showing a part of a rotary drum.
Figure 4:
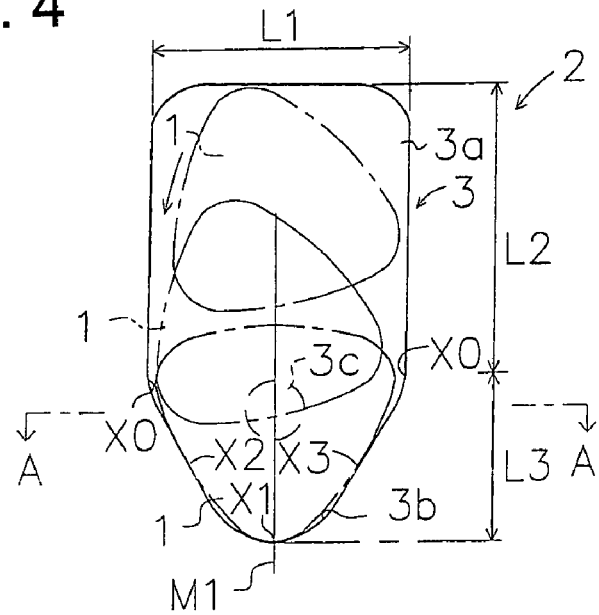
FIG. 4 is an enlarged view schematically showing a holding recess.
Figure 5:
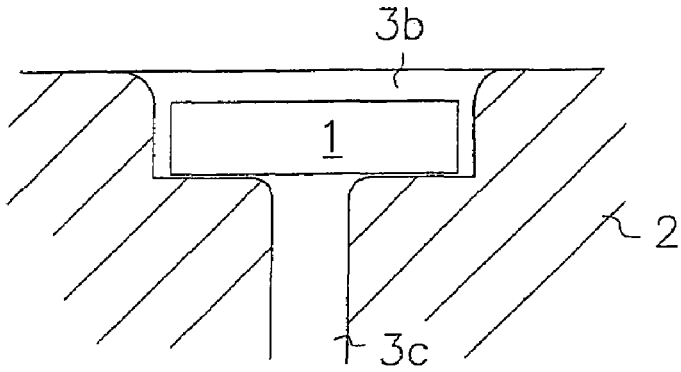
FIG. 5 is a cross sectional view taken along the A-A line in FIG. 4.

On an outer surface of the rotary drum 2, a large number of holding recesses 3 for holding the tablets 1 are formed (see FIG. 3). Each holding recess 3 is regularly aligned with a predetermined space in the rotation direction of the rotary drum 2, which is the direction for conveying the tablets 1 (namely, the direction indicated by an arrow Y). Moreover, as shown in FIGS. 3 to 5, each of the holding recesses 3 is provided with a tablet receptacle section 3*a* that is larger than the tablet 1, and a posture correction section 3*b* that is formed successively at the tablet receptacle section 3*a* for correcting the posture of the tablet 1 received by the tablet receptacle section 3*a* during the conveyance. Corresponding to the posture correction section 3*b*, a suction section 3*c* that sucks the tablet 1 whose posture is corrected by the posture correction section 3*b* is formed inside the rotary drum 2. In this embodiment, a posture maintenance means is constituted by the suction section 3*c* and a suction means. The suction section 3*c* is formed successively at the bottom of the posture correction section 3*b*, and is connected to the suction means such as a suction pump (not shown). Moreover, the bottom of the tablet receptacle section 3*a* and the bottom of posture correction section 3*b* are flush with one another, and thus the tablet 1 received by the tablet receptacle section 3*a* can move to the posture correction section 3*b* smoothly.

Specifically, the tablet receptacle section 3*a* has a shape of rectangular and is formed with a predetermined depth to receive the tablet 1 while having a length L1 larger than a width of the tablet (see FIG. 4). That is, the tablet receptacle section 3*a* is formed to be large enough so that the tablet 1 can rotate therein at least within a predetermined angle. Moreover, a length L2 of the tablet receptacle section 3*a* in the tablet conveyance direction Y is set so that it is about 2 times longer than a length L3 of the posture correction section 3*b* in the tablet conveyance direction Y. Therefore, the tablet receptacle section 3*a* has sufficient allowance. The posture correction section 3*b* is provided at the downstream of the tablet receptacle section 3*a* in the rotation direction of the rotary drum 2, and is configured to be a triangle shape so that it is narrowed toward the end, and thus contacts the tablet 1 at the forward (front end) of the tablet conveyance direction Y. In this situation, a pair of side surfaces of the posture correction section 3*b* that are tapered are axially symmetrical to an imaginary line M1 passing through the center of the posture correction section 3*b* that extends in the tablet conveyance direction Y. Thus, when the posture of the tablet 1 is corrected in the posture correction section 3*b*, the pointed portion of the tablet 1 is guided to face the downstream side of the tablet conveyance direction Y by the tapered portion of the posture correction section 3*b*. The part of the posture correction section 3*b* that contacts the tablet 1, in particular, boundary areas X0 (see FIG. 4) of the tablet receptacle section 3*a* and the posture correction section 3*b* are curved (plane curve shape) in order to prevent breakage of the tablet 1. Moreover, the posture correction section 3*b* is formed so that the tablet 1 whose posture is to be corrected will make a point contact. In this embodiment, the tablet 1 with corrected posture will contact at a central supporting point X1, a left side supporting point X2, and a right side supporting point X3, and this posture is maintained by an opening of the suction section 3*c*.

Figure 6:
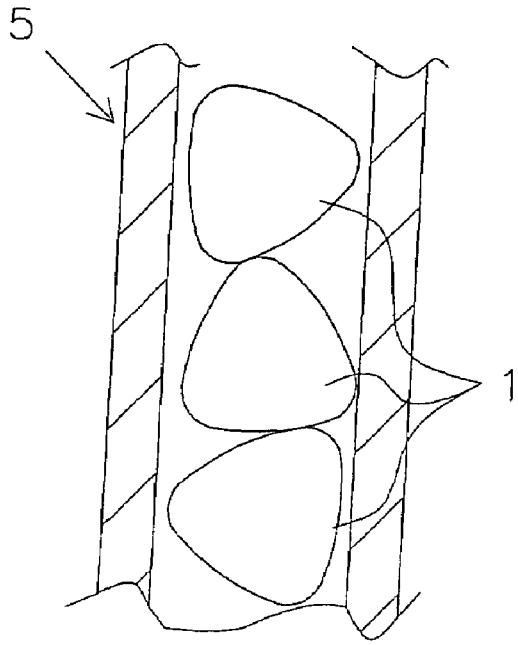
FIG. 6 is a schematic diagram for explaining the alignment condition of tablets that are supplied to a tablet feeding chute in the embodiment.

Moreover, close to an upper part of the rotary drum 2, a tablet feeding chute 5 is provided for supplying the tablets 1 to the holding recesses 3 by gravity-drop due to the own weight. The tablet feeding chute 5 is provided at the downstream (left side in FIG. 1) relative to the rotational direction of the rotary drum rather than the top area. The inside of the tablet feeding chute 5 has a hole, into which a pile of tablets 1 can be loaded in the vertical direction. In this case, since the posture of the tablet 1 will be corrected by the posture correction section 3*b*, as shown in FIG. 6, the directions of the tablets 1 that are supplied to the tablet feeding chute 5 need not be uniform. While the upstream (upper part) side of the tablet feeding chute 5 is connected with a supply area of the tablets 1, the downstream side serves as an opening to discharge the loaded tablets 1.

Further, a shutter 11 that operates for one tablet at a time is formed in the lower opening side of the tablet feeding chute 5. The tip point of the shutter 11 is located so as to correspond to the lower opening of the tablet feeding chute 5. The tip of the shutter 11 moves along the arc of the outer surface of the rotary drum 2, and closes the lower opening of the tablet feeding chute 5. That is, by positioning the shutter 11 at the closed location, free fall of the tablet 1 from the tablet feeding chute 5 is prohibited, and the supply of the next tablet 1 is prevented for a predetermined time after one tablet 1 is dropped.

Moreover, close to the flank (left side in FIG. 1) of the rotary drum 2, a half-moon guide member 6 that goes along the outer surface of the rotary drum 2 is fixedly provided. The guide member 6 guides the tablets 1 held in the holding recesses 3 of the rotary drum 2 to the lower part of the rotary drum 2 without dropping or displacing the tablets 1. When the suction of the tablet 1 is maintained as in the embodiment of the present invention, it is possible to omit the half-moon guide member 6.

The tablet 1 conveyed to the lower part of the rotary drum 2 is filled in the pocket part 44 of the container film 41 that is transported in a horizontal direction at the lower portion at the lowermost point of the rotary drum 2. That is, the rotary drum 2 approaches most closely at its lowest point to the container film 41, and releases the suction from the tablet at this point.

Next, the explanation is made on the case where the pocket part 44 of the conveyed container film 41 is filled with the tablet 1 using the tablet filling device 52 configured as explained above. First, a motor which is not shown is operated in synchronism with the conveyance operation of the container film 41, thereby synchronizing the conveyance of the container film 41 and the rotation of the rotary drum 2 with each other.

As the rotary drum 2 rotates, the tablets 1 from the tablet feeding chute 5 are stored in the tablet receptacle section 3*a* of the holding recesses 3 one by one. In this situation, in many cases, the tablet 1 is often received in the tablet receptacle section 3*a* with the posture that is different from the posture that the tablet 1 is to be filled in the pocket part 44, and it falls on the upstream location of the tablet receptacle section 3*a* (shown by the alternate long and short dash line of FIG. 4). As the rotary drum 2 rotates, the tablet 1 is moved to the downstream location of the tablet receptacle section 3*a* (shown by the double alternate long and short dash line in FIG. 4), due to its own weight, and is further moved to the posture correction section 3*b*. Then, as a result of the posture of the tablet 1 being corrected by the posture correction section 3*b*, the corner section of the tablet 1 turns to the downstream of the conveyance direction Y (shown by solid line in FIG. 4) and the posture is corrected, and after a predetermined timing, the tablet 1 is in the condition of being sucked by the suction section 3*c*. Then, as the rotary drum 2 further rotates, the tablet 1 in the posture correction section 3*b* is conveyed to the lowermost location of the drum 2 while the above-described suction condition is maintained. In this example, the pocket part 44 and the posture correction section 3*b* of the holding recess 3 correspond with each other (positionally aligned) at the lowermost position of the rotary drum 2. When the suction is released, the tablet stored in the posture correction section 3*b* is securely stored in the pocket part 44 of the container film 41 with the correct posture.

As explained in detail, according to the embodiment of the present invention, the holding recess 3 is configured by the tablet receptacle section 3*a* and the posture correction section 3*b*. Thus, the tablet 1 supplied to the holding recess 3 will be received by the tablet receptacle section 3*a* that is larger than the tablet 1, and then the posture of the tablet 1 is corrected by the posture correction section 3*b* while being conveyed as the rotary drum 2 rotates. In this case, because the tablet receptacle section 3*a* is large enough, even if the tablet 1 supplied from the tablet feeding chute 5 is non-circular, such as rounded triangle, it can securely hold the tablet 1 in the tablet receptacle section 3*a*. Since the posture of the tablet 1 is appropriately corrected by the posture correction section 3*b*, the posture of the tablet 1 when it is filled in the pocket part 44 of the container film 41 is also corrected, thereby reducing errors in filling the tablet. Accordingly, it is possible to improve the quality and productivity of the PTP sheet. Moreover, since the posture of the tablet 1 is corrected by the posture correction section 3*b* even if the direction of the tablets 1 supplied to the tablet feeding chute 5 varies, a mechanism to line up the tablet 1 in a predetermined direction to be stored in the tablet feeding chute 5 becomes unnecessary. Therefore, the manufacturing cost can be reduced.

Moreover, since the posture correction section 3*b* is arranged at the downstream of the rotation direction of the rotary drum compared to the tablet receptacle section 3*a*, as the rotary drum 2 rotates, the tablet 1 received by the tablet receptacle section 3*a* is moved to the posture correction section 3*b*. Thus, with the rotation of the rotary drum 2, the posture of the tablet 1 is corrected automatically. For this reason, the posture can be corrected easily, without involving complication of equipment.

Moreover, as the rotary drum 2 rotates, the tablet 1 contacts by the front (tip) side of the tablet conveyance direction Y in the posture correction section 3*b* when the tablet 1 is transferred to the posture correction section 3*b*. Thus, the stop position of the tablet 1 is determined and positioning becomes certain and easy. Moreover, since the boundary part X0 between the tablet receptacle section 3*a* and the posture correction section 3*b* is a curved surface, the impact applied to the tablet 1 during the conveyance decreases and breakage of the tablet 1 can be prevented. Moreover, since the tablet 1 with corrected posture makes a point contact at the posture correction section 3*b*, the contact location of the tablet 1 becomes certain and the location or posture deviation of the tablet 1 can be prevented. The posture of the tablet 1 at the time it is filled in the pocket part 44 of the container film 41 is further corrected, and defects in filling the tablet can be prevented.

In the embodiment of the present invention described above, a part of the configuration may also be modified as described below. Needless to say, other examples not illustrated below are possible as well.

(a) The rotary drum in the above-mentioned embodiment may be replaced by other tablet conveyance body. For example, a belt-like body may be adopted.

(b) The part of the posture correction section that contacts the tablet need not be arched so long as it does not damage the tablet.

(c) As long as the configuration of the posture correction section corrects the posture of a tablet, it need not be a tapered triangular shape, and for example, it may be a tapered rectangular shape.

(d) The part of the posture correction section that supports the tablet need not make a point contact but may make a surface contact.

(e) The tablets in the tablet feeding chute need not be piled vertically. For example, a tablet feeding chute of a horizontal piling type may also be adopted.

(f) The shape of the tablet is not limited to the tablet used in the embodiment. The tablet may be non-circular with corners, such as a square and a rhombus, or it may be a circle. Moreover, the tablet may also be a capsule. For example, in the case where a non-circular tablet with corners is used, the tablet may preferably have rounded corners rather than sharp corners in order to prevent damages to the tablet.

(g) In the embodiment described above, the posture correction section 3*b* in the holding recess 3 on the rotary drum 2 maintains the tablet 1 by the suction mechanism. However, the suction maintenance mechanism may be omitted as long as the configuration allows the tablet to be kept in a corrected posture.

(h) In the embodiment described above, the tablet feeding chute 5 is formed at the downstream compared to the top of the rotary drum 2, and the tablet 1 is received by the tablet receptacle section 3*a* of the holding recess 3 from the tablet feeding chute 5 at the downstream relative to the top of the drum (left side in FIG. 1). However, the following modification is also possible. That is, the tablet feeding chute may be provided at the upstream compared to the top of the rotary drum 2 (right side in FIG. 1). In that case, the holding recess established on the rotary drum is formed in such a way that the posture correction section is arranged at the upstream side of rotation direction of the rotary drum. Thus, at the upstream of the top of the rotary drum, when the tablet is received in the tablet receptacle section of the holding recess from the tablet feeding chute, the tablet will be moved to the posture correction section at the upstream of the rotational direction of the drum by its own weight, and the posture of a tablet will be corrected in the posture correction section. However, in such a configuration, when the rotary drum rotates further and the location of the holding recess in which the tablet was received crosses the top of the rotary drum, the tablet with corrected posture may move again toward the tablet receptacle section from the posture correction section. In this regard, the problem that the tablet may move back toward the tablet receptacle as described above can be prevented by maintaining the tablet whose posture is corrected by the posture correction section by the suction mechanism described above. In short, the posture correction section of the holding recess is not necessarily formed at the downstream of the conveyance direction (rotation direction of the rotary drum) relative to the tablet receptacle. It may be arranged at the upstream of the conveyance direction if necessary.

What is claimed is:

1. A tablet filling device for filling a tablet into a pocket part of a container film by transferring the tablet to downstream, comprising:

a tablet feeding chute to supply tablets; and a rotary drum having holding recesses for holding the tablets from the tablet feeding chute;

wherein said holding recess has a tablet receptacle section that is larger than the tablet supplied from the tablet feeding chute, a posture correction section that corrects the posture of the tablet received in the tablet receptacle section during conveyance so that the pointed corner of the tablet will face the downstream of the conveyance; and wherein said posture correction section is formed so that it is tapered toward a tablet transfer direction to correspond to said pointed corner of the tablet, and a bottom of said tablet receptacle section and a bottom of said posture correction section are flush with one another, and the tablet received by said tablet receptacle section is moved to said posture correction section by its own weight upon rotation of said rotary drum.

2. The tablet filling device as described in claim 1, wherein the posture correction section is arranged at the downstream of a tablet conveyance direction.

3. The tablet filling device as described in claim 1, wherein the holding recesses are arranged along a direction of an outer surface of the rotary drum, and the posture correction section is arranged at the downstream side in the rotation direction of the rotary drum relative to the tablet receptacle section.

4. The tablet filling device as described in claim 1, wherein the tablet receptacle section has a width that allows rotation of the tablet when the received tablet is moved to the posture correction section.

5. The tablet filling device as described in claim 1, wherein tapered side wall surfaces of the posture correction section are axially symmetrical with one another with respect to an imaginary line that passes about a center of the posture correction section that extends to a tablet conveyance direction.

6. The tablet filling device as described in claim 1, wherein the posture correction section is formed to make a contact with the tablet at the front side of the tablet conveyance direction.

7. The tablet filling device as described in claim 1, wherein a part of the posture correction section that makes a contact with the tablet is curved.

8. The tablet filling device as described in claim 1, wherein the posture correction section makes a point contact with the tablet in plan view.

9. The tablet filling device as described in claim 8, wherein the posture correction section makes contacts with the tablet at a central support point and left and right support points.

10. The tablet filling device as described in claim 1, wherein, when the tablet is filled in the pocket part of the container film, a position of the posture correction section in the holding recess and a position of the pocket part of the container film to be transferred are aligned with one another.

11. The tablet filling device as described in any one of claims 1-2, 3-4, 5-9 and 10, wherein the tablet filling device is equipped in a PTP packaging machine.

* * * * *

UNITED STATES PATENT AND TRADEMARK OFFICE

CERTIFICATE OF CORRECTION

PATENT NO. : 7,407,050 B2
APPLICATION NO. : 11/243555
DATED : August 5, 2008
INVENTOR(S) : Maruyama et al.

It is certified that error appears in the above-identified patent and that said Letters Patent is hereby corrected as shown below:

Title Page, Insert the Follow:

(22) PCT Filed: December 22, 2003

(86) PCT No.: PCT/JP2003/016502
371(c)(1), (2), (4) Date: Oct. 5, 2005

(87) PCT Pub. No.: WO04/101361
PCT Pub. Date: Nov. 25, 2004

Signed and Sealed this

Twenty-eighth Day of October, 2008

JON W. DUDAS
*Director of the United States Patent and Trademark Office*